US007759640B2

(12) United States Patent
Setou et al.

(10) Patent No.: US 7,759,640 B2
(45) Date of Patent: Jul. 20, 2010

(54) MASS SPECTROMETER

(75) Inventors: Mitsutoshi Setou, Hamamatsu (JP); Shuichi Shimma, Toyonaka (JP); Takahiro Harada, Uji (JP); Sadao Takeuchi, Nagaokakyo (JP); Osamu Furuhashi, Uji (JP); Kiyoshi Ogawa, Kizugawa (JP); Yoshikazu Yoshida, Kyotanabe (JP)

(73) Assignee: Shimadzu Corporation, Kyoto (JP)

( * ) Notice: Subject to any disclaimer, the term of this patent is extended or adjusted under 35 U.S.C. 154(b) by 294 days.

(21) Appl. No.: 12/063,625

(22) PCT Filed: Aug. 10, 2006

(86) PCT No.: PCT/JP2006/315803

§ 371 (c)(1),
(2), (4) Date: Feb. 12, 2008

(87) PCT Pub. No.: WO2007/020862

PCT Pub. Date: Feb. 22, 2007

(65) Prior Publication Data

US 2009/0146053 A1 Jun. 11, 2009

(30) Foreign Application Priority Data

Aug. 12, 2005 (JP) ..... 2005-233892

(51) Int. Cl.
*H01J 49/04* (2006.01)

(52) U.S. Cl. ..... 250/288; 250/281; 250/491.1; 250/311; 250/307; 250/310

(58) Field of Classification Search ..... 250/311, 250/396 R, 492.2, 492.1, 307, 310, 281, 491.1, 250/288

See application file for complete search history.

(56) References Cited

U.S. PATENT DOCUMENTS

2003/0116720 A1* 6/2003 Yamaguchi et al. ..... 250/491.1

(Continued)

FOREIGN PATENT DOCUMENTS

JP 04-154040 A 5/1992

(Continued)

OTHER PUBLICATIONS

Pierre Chaurand, et al, "Profiling and Imaging Proteins in Tissue Sections by MS", Analytical Chemistry, Mar. 1, 2004, pp. 86A-93A, vol. 76, No. 5.

(Continued)

*Primary Examiner*—Jack I Berman
*Assistant Examiner*—Meenakshi S Sahu
(74) *Attorney, Agent, or Firm*—Sughrue Mion, PLLC

(57) ABSTRACT

In a mass spectrometer for carrying out mass analysis while microscopically observing a two-dimensional area of a sample 15, the observation position for selecting a target portion while observing an image of the sample 15 captured with a CCD camera 23 is separated from the analysis position for carrying out the mass analysis of the sample 15 by delivering laser light from the laser-delivering unit 20 onto the sample 15. The sample 15 is placed on a stage 13, which can be precisely moved between the observation position and the analysis position by a stage-driving mechanism 30. An observation optical system 24 can be set close to the sample 15 at the observation position, without impeding the flight of the ions generated from the sample 15 during the analysis or interfering with a laser-condensing optical system 22. Thus, the spatial resolution for observation is improved without deteriorating the ion-detecting efficiency.

13 Claims, 7 Drawing Sheets

U.S. PATENT DOCUMENTS

| | | | | |
|---|---|---|---|---|
| 2009/0146053 | A1* | 6/2009 | Setou et al. | 250/281 |
| 2010/0044563 | A1* | 2/2010 | Harada et al. | 250/288 |

FOREIGN PATENT DOCUMENTS

| | | | |
|---|---|---|---|
| JP | 09-304343 | A | 11/1997 |
| JP | 2001-154112 | A | 6/2001 |
| JP | 2004-184137 | A | 7/2004 |
| WO | 01/40735 | A1 | 6/2001 |
| WO | 2004/051253 | A1 | 6/2004 |

OTHER PUBLICATIONS

Richard M. Caprioli, et al, "Molecular Imaging of Biological Samples: Localization of Peptides and Proteins Using MALDI-TOF MS", Analytical Chemistry, Dec. 1, 1997, pp. 4751-4760, vol. 69, No. 23.

Bernhard Spengler, et al., "Scanning Microprobe Matrix-Assisted Laser Desorption Inoization (SMALDI) Mass Spectrometry: Instrumentation for Sub-Micrometer Resolved LDI and MALDI Surface Analysis", Journal of American Society for Mass Spectrometry, 2002, pp. 735-748, vol. 13, No. 6.

* cited by examiner (a) INITIAL STATE (b) POSITIONING OF TARGET PORTION (c) MOVING TO LASER IRRADIATION POSITION (a) INITIAL STATE (b) POSITIONING OF TARGET PORTION (c) MOVING TO LASER IRRADIATION POSITION

MASS SPECTROMETER

TECHNICAL FIELD

The present invention relates to a mass spectrometer having an ion source which ionizes a sample by irradiating the sample with laser light. Specifically, it relates to a mass spectrometer with an ion source which uses a laser desorption ionization (LDI) or matrix-assisted laser desorption ionization (MALDI) technique.

BACKGROUND ART

Laser desorption ionization (LDI) is a technique in which laser light is delivered onto a sample to help the transfer of electrons within the substance that has absorbed the laser light. Matrix-assisted laser desorption ionization (MALDI) is a technique suitable for an analysis of samples that barely absorb laser light or samples that will be easily damaged by laser light, such as protein. In this technique, a substance that is highly absorptive of laser light and easy to ionize is mixed beforehand into the sample, and this mixture is irradiated with laser light to ionize the sample. Particularly, mass spectrometers using the MALDI technique can analyze high molecular compounds having large molecular weights without severely dissociating them. Moreover, mass spectrometers of this type are suitable for microanalysis. Due to these characteristics, the MALDI mass spectrometers are widely used in biosciences and other fields. In the following description, mass spectrometers with an ion source using an LDI or MALDI technique are generally referred to as the FIG. 5 is a schematic view of a conventional LDI-MALDI-MS having a typical construction. This system includes a vacuum chamber 10, which is evacuated by a vacuum pump (not shown). The chamber 10 contains a stage 13, ion transport optical system 16, mass analyzer 17, detector 18 and other components arranged in an approximately straight line. Located outside the chamber 10 are a laser-delivering unit 20, laser-condensing optical system 22, CCD camera 23, observation optical system 24 and other components. A sample to be analyzed 15 is applied or placed on a sample plate 14. This plate 14 is set on a stage 13, which can be horizontally moved along the x and y directions. Examples of the ion transport optical system 16 include an electrostatically-operated electromagnetic lens, a multi-polar radio-frequency ion guide, or a combination of these devices. The mass analyzer 17 may be a quadrupole mass spectrometer, ion trap, time-of-flight mass spectrometer, magnetic sector mass spectrometer, or other types of mass spectrometers.

An analysis with the previous mass spectrometer involves the following steps: An operator initially determines which portion of the sample 15 should be analyzed. To help him/her with this task, an image of the sample 15 is captured with the CCD camera 23 through the observation window 12 and the observation optical system 24, which are located in a side of the vacuum chamber 10, and the image is displayed on a monitor (not shown). FIGS. 9(*a*) and 9(*b*) are top views of the stage 13.

In FIGS. 9(*a*) and 9(*b*), the rectangle 23*a* indicated by the dotted line corresponds to the scope of the CCD camera 23*a*, and the approximately spherical, shaded range 21*a* corresponds to the irradiation range of the laser light 21. The scope 23*a* is larger than the convergence diameter of the laser light 21. The center of the irradiation range 21*a* of the laser light 21 approximately coincides with that of the scope 23*a*. Accordingly, the irradiation range 21*a* of the laser light 21 can be completely covered by the scope 23*a*, as shown in FIG. 9(*a*).

The diameter of the converged laser light 21 is generally smaller than the sample 15, also as shown in FIG. 9(*a*).

Observing the image of the sample 15 within the scope 23*a*, the operator appropriately moves the stage 13 along the x and y axes to locate a target portion to be analyzed. In FIGS. 9(*a*) and 9(*b*), for example, the target portion is indicated by the point 15*a*. Then, he/she brings the target portion 15*a* to the center of the laser irradiation range 21*a*, as shown in FIG. 9(*b*).

Subsequently, the operator gives a command for starting the analysis, upon which the laser-delivering unit 20 starts emitting the laser light 21. This light is condensed by the laser-condensing optical system 22 and then delivered through the irradiation window 11, which is located in a side wall of the vacuum chamber 10, onto a point in the vicinity of the target portion 15*a* on the sample 15. The laser light 21 thus delivered ionizes various substances contained in the sample 15. The ions thereby produced are emitted vertically, i.e. in directions approximately perpendicular to the sample plate 14. These ions are converged by the ion transport optical system 16 into the mass analyzer 17. The mass analyzer 17 separates the ions according to their mass-to-charge ratios and sends them to the detector 18. The detector 18 produces an electric current indicative of the number of the received ions and outputs the electric current as a detection signal. The mass analyzer 17 can be operated so that it scans a specific range of mass-to-charge ratios. In this case, with the lapse of time, the detector 18 consecutively detects several kinds of ions having different mass-to-charge ratios. The detection signals thereby produced can be used to create a mass spectrum with a data processor (not shown).

In the previous construction, the CCD camera 23 for capturing an image and displaying it on the monitor can be replaced by an eyepiece for enabling the operator to visually and directly observe a microscopic image of the sample. The observation optical system 24 may have various constructions depending on the spatial resolution for observation and/or the operational distance; it may be comprised of a single element, a module of multiple elements combined, or even a larger unit including a plurality of such modules. The laser-condensing optical system 22 may have various constructions depending on the specifications of the laser-delivering unit 20 and/or the requirement for the diameter of conversion; as in the case of the observation optical system 24, it may be comprised of a single element, a module of multiple elements combined, or even a larger unit including a plurality of such modules.

Improving the spatial resolution of the LDI/MALDI-MS will enable advantageous applications of the apparatus. For example, it can be used for examining body tissue to analyze the cause and process of a disease, clarify vital functions, or acquire versatile knowledge about sample preparation. However, conventional types of LDI/MALDI-MSs on the market are far from being available for such purposes since the diameter of converged laser light is too large (e.g. several hundreds of micrometers) and the scope of the CCD camera (or eyepiece) is too large (e.g. several millimeters in length or width). As a conventional example, Non-Patent Document 1 discloses an analysis method in which the laser light is converged to a level of several tens of micrometers in diameter. However, this level of convergence diameter is not sufficient for examining a specific portion of a living cell since the cell itself is as small as several tens of micrometers. Accordingly, it is preferably necessary to achieve a high spatial resolution of approximately a few to several micrometers.

To improve the spatial resolution of an analysis by LDI/MALDI-MS, it is necessary to:

(1) improve the spatial resolution for observing the sample;
(2) reduce the diameter of the converged laser light, which is to be delivered onto the sample;
(3) project the laser light accurately at the target point on the sample; and
(4) design the irradiation/observation optical systems so that they do not deteriorate the ion-detecting efficiency.

Some of the conventional mass spectrometers include special improvements for achieving higher spatial resolutions. For example, FIG. 6 is a schematic view of the construction of a mass spectrometer disclosed in Non-Patent Document 2. The components that are identical or equivalent to those shown in FIG. 5 are indicated by the same numerals. In the present mass spectrometer, the observation optical system 24 in FIG. 5 is replaced by a zoom lens 26, and an aperture 25 for limiting the passage area of light is provided in the vicinity of the aperture of the laser-delivering unit 20.

In FIG. 5, the laser light 21 is assumed to turn to a parallel beam immediately after it is emitted from the laser-delivering unit 20. However, strictly speaking, this is not always true; in many cases, the beam minimizes its diameter at a point within the laser-delivering unit 20 or immediately after leaving the unit. After passing that point, the beam gradually increases its diameter with its travel. In the case where the light is an ideal parallel beam, if the passage area of the light is limited by the aperture 25 as shown in FIG. 6, the numerical aperture of the laser-condensing optical system will decrease. Therefore, the convergence diameter of the laser light will increase rather than decrease. By contrast, in the case where the light is a diverging beam, the aperture 25 will reduce the minimum diameter of the beam, so that the convergence diameter, which reflects the aforementioned minimum diameter, will decrease. Unfortunately, the aperture 25 blocks a portion of the light and thereby lowers the power of the laser light. This problem can be avoided by replacing the aperture 25 with a lens for pre-focusing the light.

However, in any cases, the construction shown in FIG. 6 has a problem in that the numerical aperture of the optical systems is small since both the laser-condensing optical systems 22 and the observation optical system have large working distances. Therefore, in terms of the conversion diameter of the laser light 21 and the spatial resolution for observation, this construction cannot significantly exceed the other conventional ones.

One idea for reducing the working distance of the laser-delivering optical system and observation optical system is to place the optical systems 22 and 24 closer to the sample 15, as shown in FIG. 7. This arrangement increases the numerical apertures of the two optical systems 22 and 24, whereby the spatial resolution for observation is improved and the convergence diameter of the laser light 21 is reduced. In this arrangement, it is necessary to leave the space around the axis C as widely open as possible since the ions generated at the irradiated portion of the sample 15 are given the kinetic energy in directions approximately parallel to the surface normal to the sample plate 14, or along the axis C, and begin to fly in those directions; these ions must be prevented from being lost due to the collision with the observation optical system 24 and the laser-condensing optical system 22. Furthermore, the optical systems must be arranged so that one optical system does not interfere with any element or optical axis of the other optical system. Due to these restrictions, there is a limit for the optical systems 22 and 24 to come closer to the sample 15.

This limitation particularly causes a problem for the observation optical system 24. For example, an ultraviolet laser light can be easily converged to a diameter of a few micrometers with a working distance of several tens of millimeters by using a common, inexpensive condensing lens as the laser-condensing optical system 22. To prevent interference between the two optical systems, it is desirable that the observation optical system 24 should also have an approximately equal working distance. As another requirement, the observation optical system should have a resolution comparable to the convergence diameter of the laser light in order to assuredly move a micro-sized target portion of the sample within the irradiation range of the laser light. However, since the observation optical system does not use the highly coherent laser light but normal visible light, it is almost impossible to achieve a spatial resolution of a few micrometers with a working distance of several tens of millimeters. Thus, in the construction shown in FIG. 7, although the convergence diameter of the laser light can be reduced to a desired level, it is difficult to improve the spatial resolution for observation to a level comparable to the convergence diameter.

Non-Patent Document 3 discloses a mass spectrometer constructed as shown in FIG. 8. This construction includes a perforated optical system and a perforated mirror 28, both located above the stage 13, and a wavelength selection mirror 29 located outside the observation window 12. The perforated optical system is commonly used for both observation and laser condensation. An image of the sample 15 is captured with the CCD camera 23 through the optical system 27, the perforated mirror 28, the observation window 12 and the wavelength selection mirror 29. The laser light 21 emitted from the laser-delivering unit 20 passes through the wavelength selection mirror 29 and the observation window 29. Then, it is reflected downwards by the perforated mirror 28, condensed by the perforated optical system 27 onto the sample 15. The irradiation of laser light generates ions from the sample 15. These ions pass through the perforations of the perforated optical system 27 and the perforated mirror 28 and then reach the ion transport optical system 16.

In this construction, the perforated optical system 27 can be placed adequately close to the sample 15 without causing the previously stated problems, such as the interference of the optical systems. Therefore, the spatial resolution for observation can be significantly improved and the convergence diameter of the laser light can be considerably reduced. However, even through the ions begin to fly in directions approximately parallel to the surface normal to the sample plate 14, these ions also have velocity components in the direction perpendicular to the surface normal, so that some of the ions will be blocked by the perforated optical system 27 or the perforated mirror 28. This will inevitably lower the ion transport efficiency. Another problem exists in that the ion-generating efficiency is lower than that of the previous constructions shown in FIG. 5 or other figures since the laser light 21 loses its energy every time it passes through or reflected by the wavelength selection mirror 29, the perforated optically system 27, the perforated mirror 28 and other components.

[Non-Patent Document 1] P. Chaurand et al., "Profiling and imaging proteins in tissue sections by MS", *Analytical Chemistry,* 2004, Vol.76, No.5, p.86A-93A

[Non-Patent Document 2] R. M. Caprioli et al., "Molecular imaging of biological samples: Localization of peptides and proteins using MALDI-TOF MS", *Analytical Chemistry,* 1997, Vol. 69, No. 23, p.4751-4760

[Non-Patent Document 3] B. Spengler et al., "Scanning Microprobe Matrix-Assisted Laser Desorption Ionization (SMALDI) Mass Spectrometry: Instrumentation for Sub-Micrometer Resolved LDI and MALDI Surface Analysis," *Journal of American Society for Mass Spectrometry,* 2002, Vol.13, No.6, p.735-748

DISCLOSURE OF THE INVENTION

Problem to Be Solved By the Invention

To solve these problems, the present invention provides a mass spectrometer having a high level of spatial resolution by reducing the convergence diameter of the laser light delivered onto the sample and improving the spatial resolution for observation of the sample while ensuring the analysis sensitivity, i.e. while maintaining the ion-generating efficiency on the sample and the ion transport efficiency during the flight of the ions.

Means For Solving the Problems

To solve the previously described problems, the present invention provides a mass spectrometer for ionizing a component contained in a sample by irradiating the sample with laser light, for separating ions according to their mass-to-charge ratio, and for detecting the separated ions, including:

a) a sample observation system, including an observation optical system, for allowing an operator to observe a predetermined range of the sample with the naked eye or on a captured image and select a target portion to be analyzed;

b) a laser-delivering system, including a laser-condensing optical system, for condensing and delivering an ionizing laser light onto a predetermined point outside the aforementioned predetermined range observable through the sample observation system; and c) a sample conveyer for holding the sample and moving it so that the target portion of the sample selected by the operator through the sample observation system comes to the predetermined point onto which the laser light is delivered from the laser-delivering system.

In conventional mass spectrometers of this kind, the aforementioned predetermined range observable through the sample observation system overlaps the aforementioned predetermined point onto which a condensed laser light is delivered from the laser-delivering system. By contrast, in the mass spectrometer according to the present invention, the sample observation system and the laser-delivering system are arranged so that the aforementioned predetermined point is located outside the aforementioned predetermined range; that is, they do not overlap each other. Since the predetermined range for sample observation is separated from the predetermined point for laser irradiation, the optical axis of the sample observation system and that of the laser-delivering system can be separated from each other. Even if the observation device is located close to the sample at the observation position, the device will neither impede the flight of ions generated from the portion of the sample irradiated with the laser light nor interfere with the laser-condensing optical system or its optical axis when an analysis is performed. Therefore, the working distance of the observation optical system can be reduced to increase its numerical aperture and thereby improve the spatial resolution for observation.

If the laser-condensing optical system was too close to the sample at the analysis position, it would impede the flight of ions generated from the irradiated portion of the sample when the analysis is performed. Therefore, the laser-condensing optical system must be adequately far from the sample so that it will never impede the flight of the ion. This arrangement causes no problem since laser light is highly coherent and its beam diameter can be considerably reduced even if the working distance is longer than that of the observation optical system.

Effect of the Invention

As described thus far, the mass spectrometer according to the present invention is capable of delivering laser light onto a sample without losing the power of the laser light. Therefore, the ion-generating efficiency is maintained at high levels. The ion transport efficiency is also high since the flight of ions thereby generated is barely impeded. Thus, the analysis can be performed with high sensitivity. Both the high spatial resolution for observing the sample and the reduced convergence diameter of the laser light delivered onto the sample improve the spatial resolution of the analysis. These characteristics make the present apparatus available for analyzing a specific, micro-sized portion of a living cell, which can barely be analyzed with conventional apparatuses. Particularly, the present apparatus can be used to collect useful information in life science.

As explained previously, in the mass spectrometer according to the present invention, the predetermined range for sample observation is separated from the predetermined point for laser irradiation. After the target portion to be analyzed is selected, the sample is conveyed from the observation position to the analysis position. This suggests that the laser light may not be correctly delivered onto the target portion if the positioning accuracy of the sample-conveying operation is low and the area of the target portion is small.

To solve this problem, in a preferable mode of the present invention, the sample conveyer is constructed so that it can move the sample with a positioning accuracy finer than the irradiation size on the sample of the laser light delivered from the laser-delivering system. In this mode of mass spectrometer, even if the target portion is very small, the target portion is assuredly brought to the position onto which the laser light falls. Thus, the analysis of the target portion is assuredly carried out.

In the mass spectrometer according to the present invention, after the operator observing the sample at the observation position has selected the target portion, the sample is conveyed to the analysis position so that the target portion can be irradiated with the laser light. In some cases, this conveying operation may be manually conducted by the operator through the sample conveyer. However, such a manual operation is both time and labor consuming if there are many samples to be efficiently analyzed.

To solve this problem, in a preferable mode of the mass spectrometer according to the present invention, the sample conveyer includes:

a stage on which the sample is to be placed;

a stage driver for moving the stage within a predetermined range; and a controller for calculating a control input for moving the target portion to the predetermined point onto which the laser light is delivered, when a position on the sample is selected as the target portion during the observation through the sample observation system, and for operating the stage driver according to the control input thereby calculated.

In this mode of mass spectrometer, after the operator selects the target portion, the positioning is automatically accomplished so that the laser light is delivered onto the target portion. Therefore, the apparatus is as easy to operate as the conventional one in which the predetermined range for observation overlaps the predetermined point of laser irradiation.

In the mass spectrometer according to the present invention, the sample observation system may be constructed so that the aforementioned predetermined range is observed substantially vertical from above.

In this mode of mass spectrometer, since the state of the sample is observed from above, the operator can easily locate the desired portion even if the surface of the sample is uneven.

In a preferable mode of the mass spectrometer according to the present invention, the laser-delivering system may be constructed so that the convergence diameter of the laser light delivered onto the aforementioned predetermined point can be varied.

Too much reduction of the convergence diameter of the laser light may cause the number of excited molecules to be too small and the signal too weak. In the present mode of the mass spectrometer, the convergence diameter of the laser light can be appropriately controlled according to the analysis purpose or other factors so as to obtain adequately strong signals while ensuring a necessary spatial resolution. Thus, the analysis can be always performed with high sensitivity.

In a mode of the mass spectrometer according to the present invention, the mass spectrometer has an operational mode for carrying out an analysis by delivering the laser light onto the sample while moving the sample with the sample conveyer, so as to obtain two-dimensional distribution information about the presence and/or strength of the signal corresponding to molecules of a given mass within a given area on the sample selected by the operator using the sample observation system.

This mass spectrometer is capable of a mapping analysis of a given area on the sample with high spatial resolution. This function further adds value to the apparatus.

BRIEF DESCRIPTION OF THE DRAWINGS

FIGS. 9(*a*) through 9 (*b*) are top views of a sample in the LDI/MALDI-MS shown in

FIG. 5.

BEST MODE FOR CARRYING OUT THE INVENTION

Figure 1:
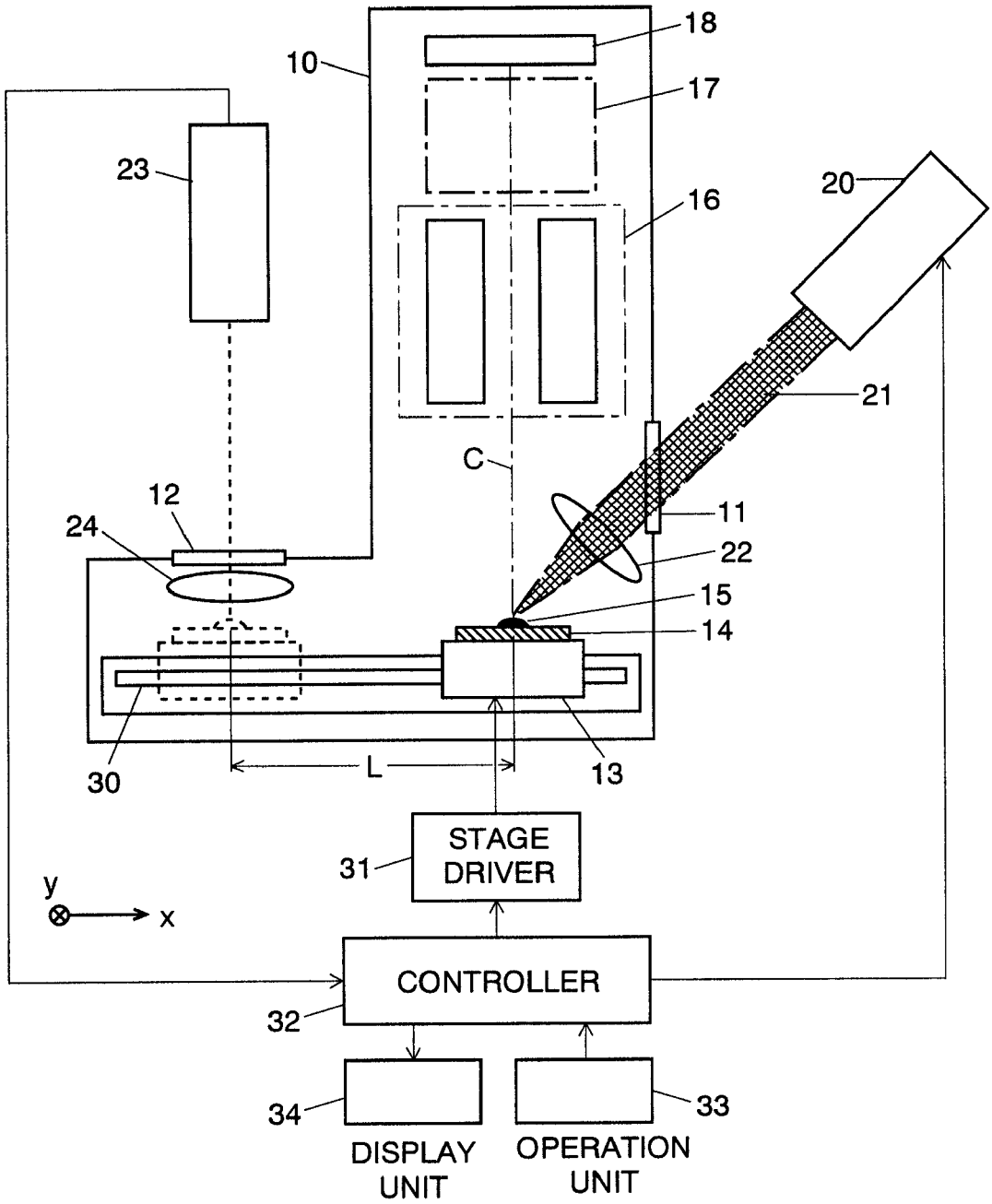
FIG. 1 is a schematic view showing the overall construction of an LDI/MALDI-MS according to the first embodiment of the present invention.

As an embodiment of the mass spectrometer according to the present invention, an LDI/MALDI-MS is described with reference to the attached drawings. FIG. 1 is a schematic view showing the overall construction of an LDI/MALDI-MS according to an embodiment (first embodiment) of the present invention. In FIG. 1, the components that are identical to those shown in FIGS. 4 through 7 are indicated by the same numerals, and explanations of those components are omitted below.

In the LDI/MALDI-MS according to the first embodiment, the stage 13, on which the sample plate 14 is to be placed, is slidable over a large distance, particularly along the x-axis. In FIG. 1, the position of the stage 13 indicated by the solid line is in the analysis position, and the position indicated by the dotted line is in the observation position. It should be noted that both the analysis position and the observation position do not take a definite, single value; they each have some range. These ranges are determined according to the size of the sample 15. If the sample 15 is small, both the analysis position and the observation position will be small. Conversely, the two positions will be broad if the sample 15 is large.

When the sample is in the analysis position, the laser light 21 emitted from the laser-delivering unit 20 is condensed by the laser-condensing optical system 22, which is located close to the sample 15, and falls onto the predetermined point of the sample 15. The components for mass analysis (i.e. ion transport optical system 16, mass analyzer 17 and detector 18) are located along the axis C, above the sample 15 at the analysis position. The CCD camera 23 is oriented approximately vertical and directed downwards. When the sample 15 is at the observation position, the camera captures an image of the aforementioned range on the sample 15 through the observation window 12 and the observation optical system 24.

Figure 2:
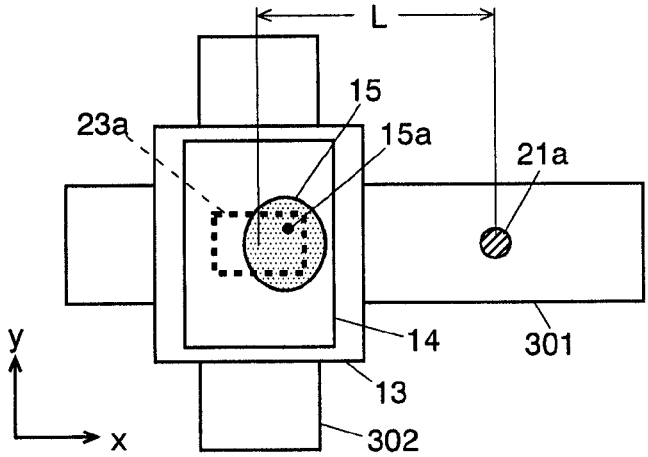
FIGS. 2(*a*) through 2(*c*) are top views of a sample in the LDI/MALDI-MS of the first embodiment.
Figure 2:
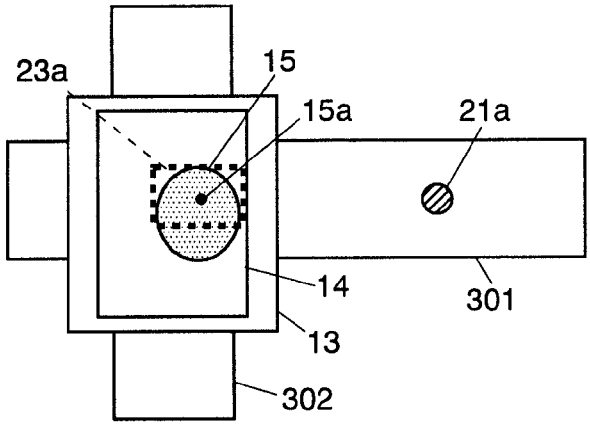
Figure 2:
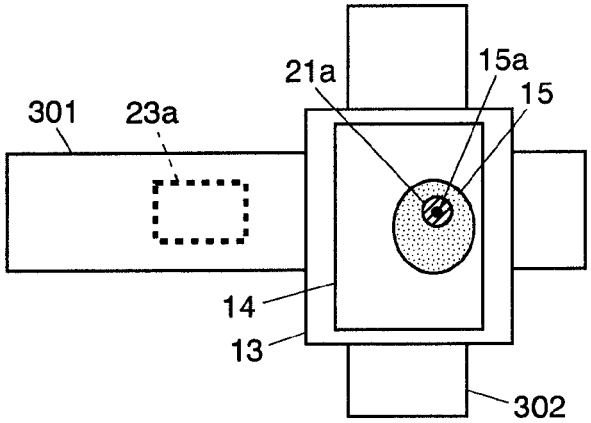

The most important feature of the apparatus according to the present embodiment exists in that, unlike the conventional apparatus in which the irradiation range of the laser light 21 emitted from the laser-delivering unit 20 is overlapped the scope of the CCD camera 23 for observing the sample 15, the irradiation range and the camera scope of the present apparatus are separated from each other in the x-direction. FIGS. 2(*a*) through 2(*c*) are top views showing the entire movable range of the stage 13 in the first embodiment. The stage 13 is movable within a predetermined range along the y-axis guide 302 extending in the y-direction. The y-axis guide 302 is movable within a predetermined range along the x-axis guide 301 extending in the x-direction. As clearly shown in these figures, the center of the scope of the CCD camera 23*a* and the center of the laser irradiation range 21*a* are separated from each other in the x-direction by distance L.

Since the scope 23*a* is separated from the laser irradiation range 21*a*, the observation optical system 24 never interferes with the laser-condensing optical system 22 or the flight path of the ions flying out from the sample 15. Therefore, the observation optical system 24 can be set close to the sample 15 to improve the spatial resolution of the microscopic observation.

The analysis operation by the LDI/MALDI-MS of the first embodiment is as follows: First, the operator enters a command for starting the sample observation through the operation unit 33. Then, under the command of the controller, the stage driver 31 actuates the stage driving mechanism 30 to move the stage 13 to an initial observation point. In this state, the CCD camera 23 captures an image of the object within the scope 23*a*. This image is displayed on the screen of the display unit 34 by the controller 32. As explained earlier, this microscopically observed image has a high resolution so that even minute portions can be clearly seen. Then, using the operation unit 33, the operator appropriately moves the stage 13 in the x and y directions so that the target portion 15*a* on the sample 15 comes to the central (reference) point of the scope 23*a*, as shown in FIG. 2(*b*).

Next, the operator enters a command for completing the positioning of the target portion 15*a* to the reference point through the operation unit 33. Then, the controller 32 operates the stage driver 31 to move so that the stage 13 moves along the x-axis by the aforementioned distance L. The stage driver 31 in turn actuates the stage-driving mechanism 30. The control input corresponding to the distance L is obtained beforehand by calculation or calibration. As a result, the stage 13 is conveyed along the x-axis so that the target portion 15*a* comes to the center of the laser-irradiation range 21*a*, as shown in FIG. 2(*c*). Now, the apparatus is ready for the analysis.

Subsequently, when an analysis-starting command is given, the laser-delivering unit 20 starts emitting the laser light 21. This light is condensed by the laser-condensing optical system into a very thin beam and delivered onto the target portion 15*a* on the sample 15, where ions are generated around that portion. These ions are efficiently trapped into the ion transport optical system 16 and transferred through the mass analyzer 17 to the detector 18.

Instead of the previously described manual operation, the movement of the stage 13 for bringing the target portion 15*a* selected on the sample 15 to the central (reference) point of the scope 23*a* may be automatically achieved as follows: A marker for selecting the target portion is displayed on the image of the scope 23*a*. The operator moves the marker on the screen to select a target portion 15*a* (the stage 13 does not move at this moment). Then, the distance between the selected target portion 15*a* and a reference point of the screen is calculated from, for example, a previously computed relationship between the coordinate values on the screen and the actual moving distances of the stage 13. The control objective values for actually moving the stage 13 with the stage-driving mechanism 30 can be obtained by the addition and subtraction of the calculated distance and the amount of movement corresponding to the aforementioned distance L.

Instead of automatically moving the sample 13, it is possible to allow the operator to manually move the stage to a predetermined position or by a predetermined distance.

In the construction described thus far, the moving distance of the stage 13 is larger than in the conventional cases. The structure of such a mechanism will be simple if a stage 13 having a large movable range is used. However, generally speaking, a stage 13 having a larger movable range is more expensive. This problem is addressed by the following (second) embodiment of the LDI/MALDI-MS according to the present invention.

Figure 3:
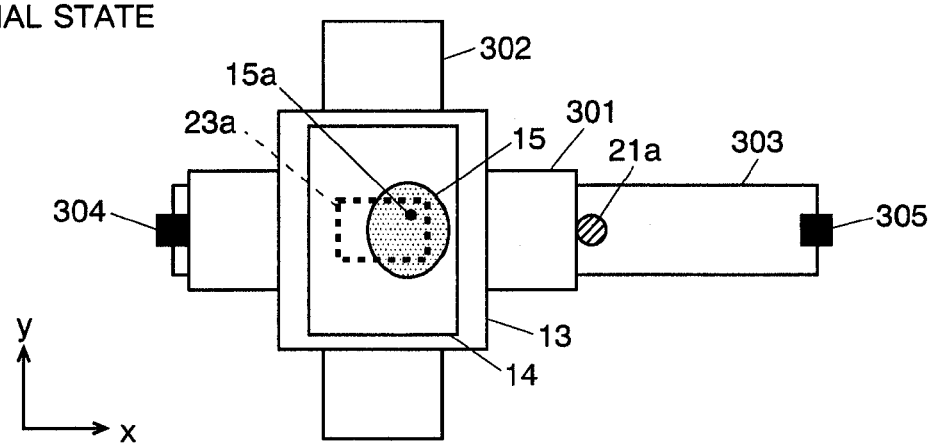
FIGS. 3(*a*) through 3(*c*) are top views of a sample in an LDI/MALDI-MS according to the second embodiment of the present invention.
Figure 3:
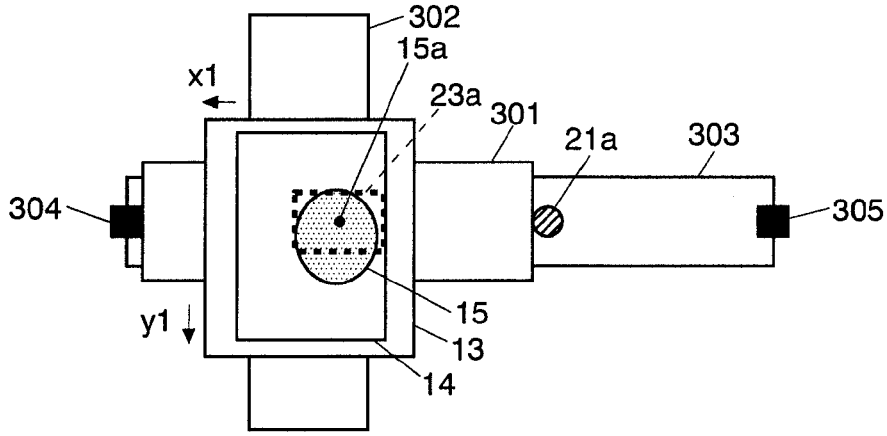
Figure 3:
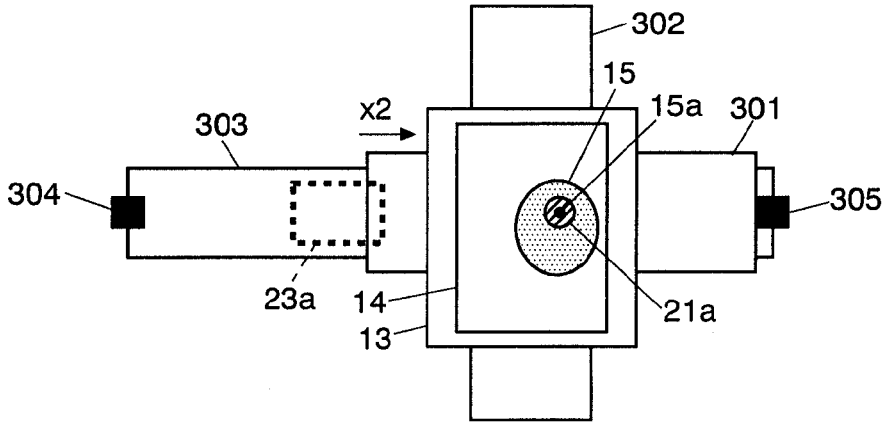

FIGS. 3(*a*) through 3(*c*) are top views showing the entire movable range of the stage 13 of the LDI/MALDI-MS of the second embodiment. In this example, the stage 13 is identical to the conventional one and has small movable ranges in the x and y directions along the x-axis guide 301 and the y-axis guide 302, yet this unit of stage 13, x-axis guide 301 and y-axis guide 302 is now slidable on a rail 303 extending in the x-direction. The rail 303 has stoppers 304 and 305 at both ends, respectively. The position at which the left end of the x-axis guide 301 touches the left stopper 304 is in the observation position. The position at which the right end of the x-axis guide 301 touches the right stopper 305 is in the analysis position.

After the position of the stage 13 is adjusted so that the target portion 15*a* comes to the central (reference) point of the scope 23*a* as shown in FIG. 3(*b*), the entire unit of the stage unit 13 is moved to the position where the right end of the x-axis guide 301 touches the right stopper 305. As a result, the target portion 15*a* will be located at the center of the laser irradiation range 21*a*, as shown in FIG. 3(*c*). Thus, the operation intended by the present invention can be achieved using a stage having a small movable range.

Figure 4:
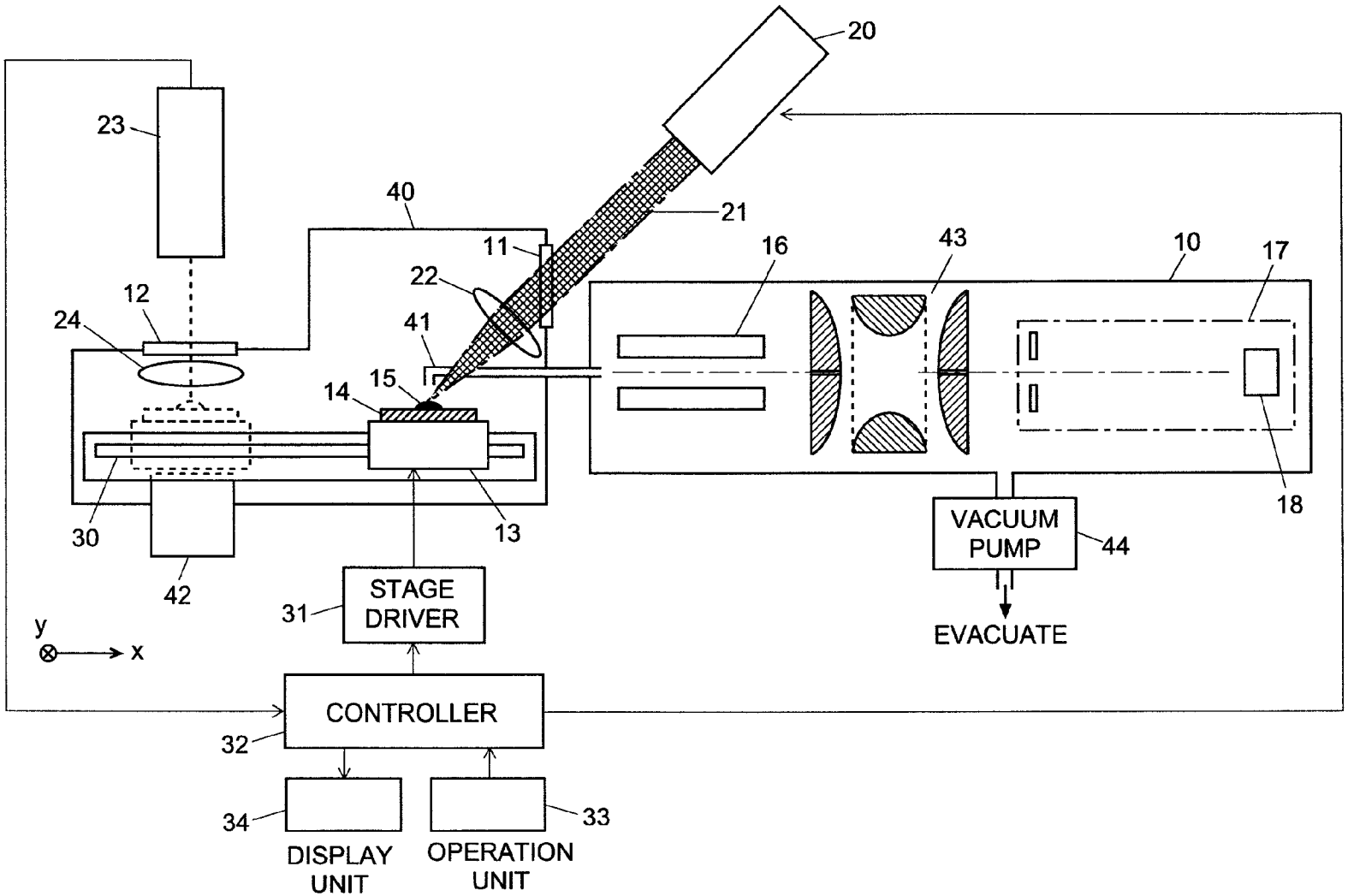
FIG. 4 is a schematic view showing the overall construction of an LDI/MALDI-MS according to the third embodiment of the present invention.
Figure 5:
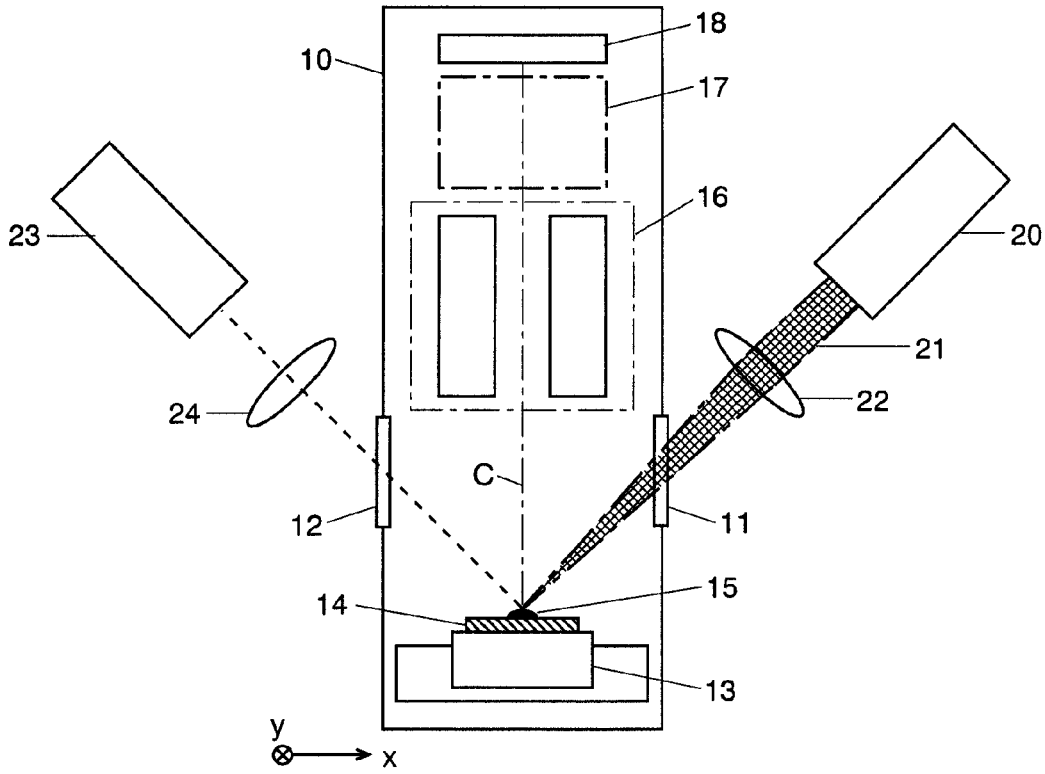
FIG. 5 is a schematic view showing the overall construction of a conventional LDI/MALDI-MS.
Figure 6:
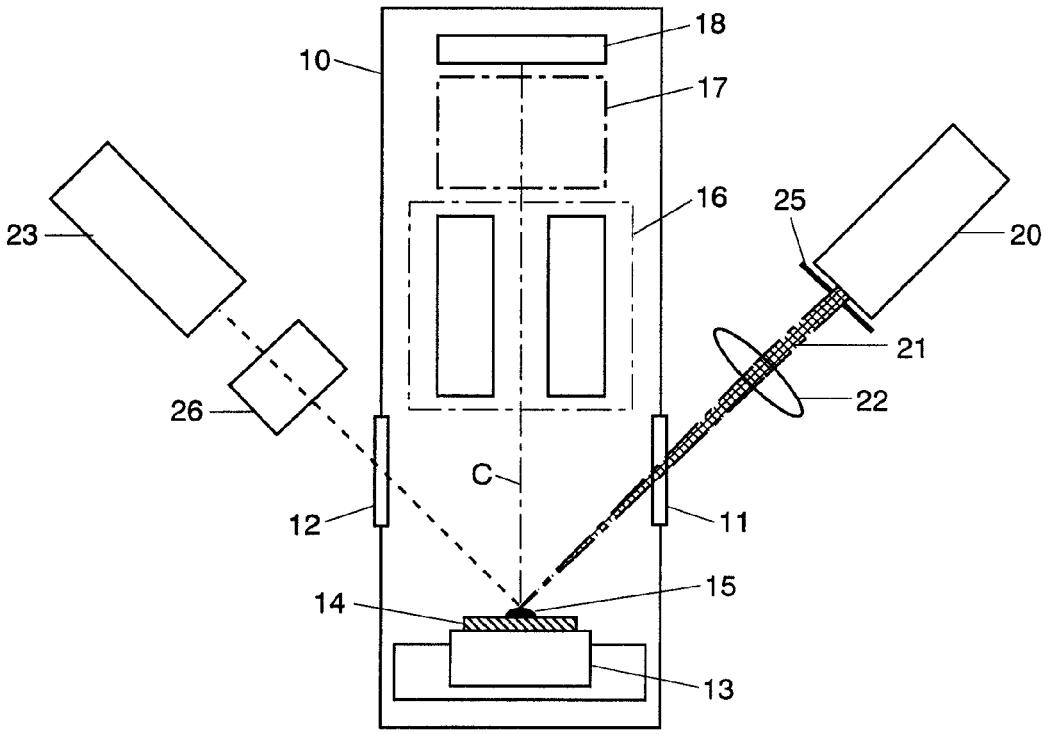
FIG. 6 is a schematic view showing the overall construction of another conventional LDI/MALDI-MS.
Figure 7:
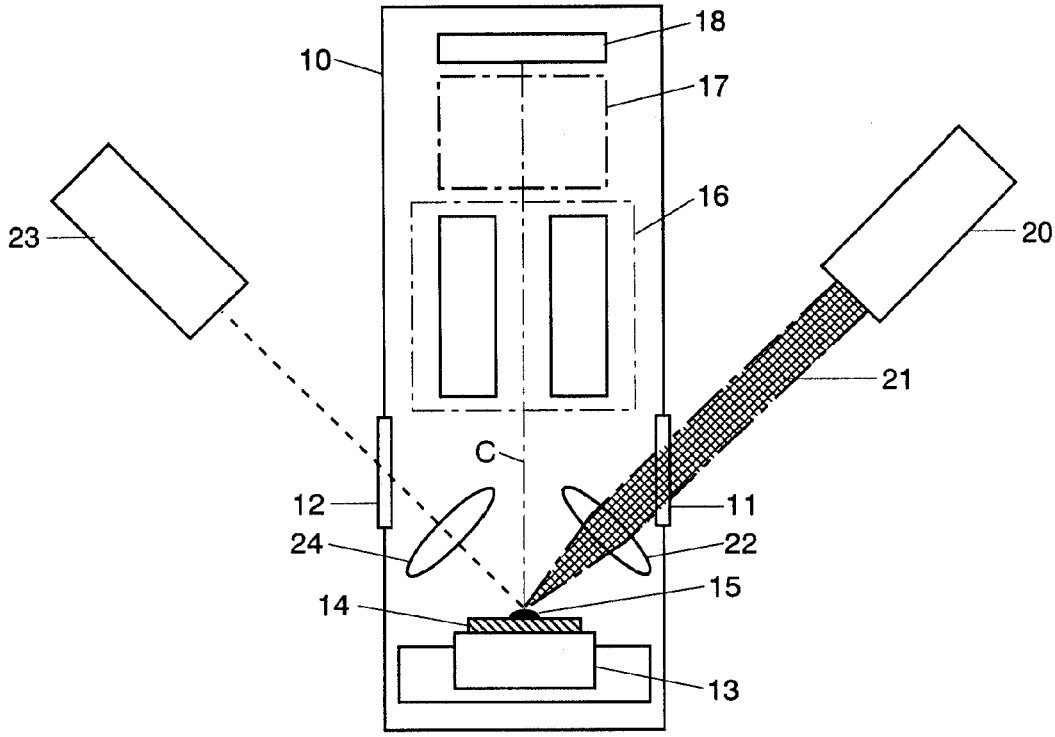
FIG. 7 is a schematic view showing the overall construction of another conventional LDI/MALDI-MS.
Figure 8:
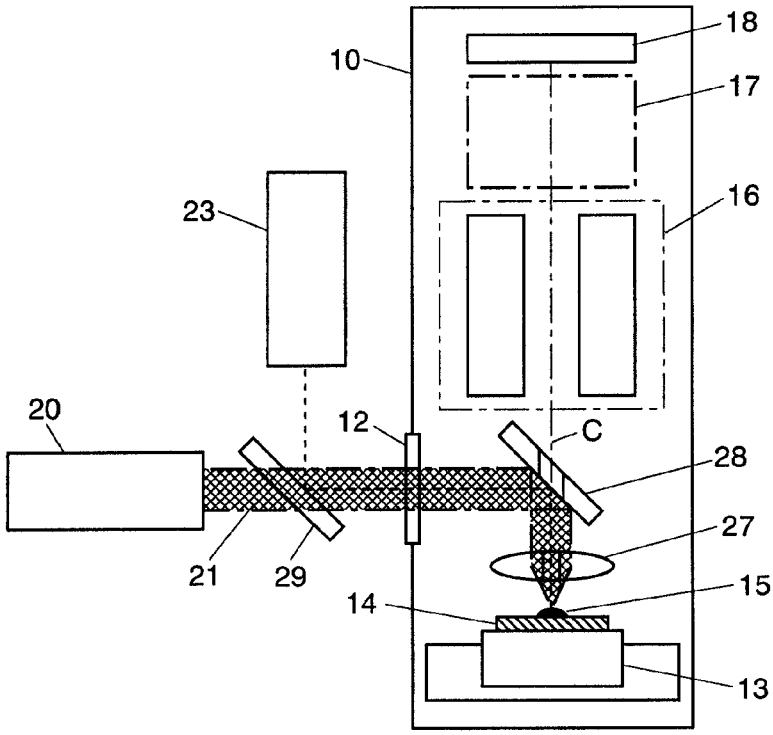
FIG. 8 is a schematic view showing the overall construction of another conventional LDI/MALDI-MS.
Figure 9:
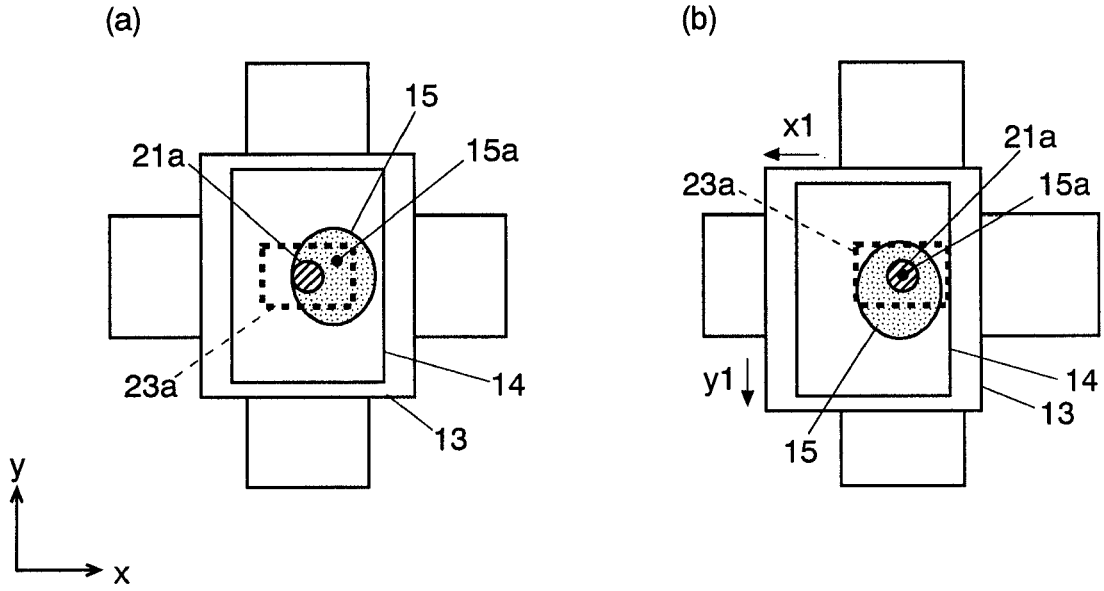

As the third embodiment of the present invention, an LDI/MALDI-MS which is particularly suitable for the microscopic mass analysis of biological samples, such as body tissue or living cells, is described with reference to FIG. 4, which shows the overall construction of the LDI/MALDI-MS of the third embodiment. The components that are identical to those of the first embodiment (and the prior art) are given the same numerals.

As opposed to the apparatus of the first embodiment in which the ionization unit for generating ions by irradiating the sample 15 with laser light and the microscopic observation unit for microscopically observing the sample 15 are located within the vacuum chamber 10, the apparatus of the third embodiment has the ionization unit and microscopic observation unit contained in an air-tight chamber 40, which is separated from the vacuum chamber 4 evacuated by the vacuum pump 44. The gas pressure within the air-tight chamber 40 can be regulated at a desired level independent of the pressure within the vacuum chamber 10. This construction makes it possible to maintain the air-tight chamber 40 approximately at atmospheric pressure so as to ionize the sample 15 by an atmospheric LDI/MALDI technique.

At the observation position, a transmission lighting unit 42 is located opposite to the CCD camera 23. When the sample 15 is at the observation position, the light emitted from the transmission lighting unit 42 illuminates the bottom side of the sample 15 through a hole created in the stage 13. This illumination creates a sample image, which can be observed through the CCD camera 23 (or a microscope). It is of course possible to also provide another lighting unit for reflection observation or luminescence observation in addition to the one for transmission observation.

In the present embodiment, the mass analyzer 17 within the vacuum chamber 10 is a time-of-flight (TOF) mass spectrometer combined with an ion trap 43 located in the previous stage. Within the ion trap 43, ions having a specific mass-to-charge ratio are selected as precursor ions from various kinds of ions introduced into the ion trap 43. Then, the precursor ions are broken into product ions by collision induced dissociation (CID). Subsequently, these product ions are subjected to the TOF mass analysis. In summary, this apparatus is capable of an MS/MS or $MS^n$ analysis.

The analysis operation by the present LDI/MALDI-MS is as follows: First, as in the case of the LDI/MALDI-MS of the first embodiment, a biological sample as the sample 15 is moved to the observation position. Then, the transmission lighting unit 42 is energized to illuminate the sample 15. The CCD camera 23 receives the transmitted light and creates a sample image. On the basis of this image, the mass analysis range is determined, after which the analysis is started. Then, the stage 13 is moved to set the sample 15 in the analysis position, onto which the laser light 21 is delivered under an approximately atmospheric pressure. As a result, ions are generated from the sample 15. Performing these processes under atmospheric pressure prevents the sample 15 from degenerating, e.g. being dried.

The ions generated from the sample 15 are drawn through the sample introduction pipe 41 into the air-tight chamber 40 and then transferred through the ion transport optical system 16 into the ion trap 43. In the ion trap 43, for example, ions having a specific mass-to-charge ratio are left inside and these ions are broken into various kinds of product ions due to contact with a CID gas introduced from the outside. Then, those product ions are separated by the mass analyzer 17 according to their mass-to-charge ratios and detected by the detector 18. The mass spectrum obtained by such an MS/MS or $MS^n$ analysis is analyzed to identify the substance present at the analyzed portion. Repeating such an analysis process over a predetermined range on the sample 15 will enable the mass spectrometric imaging of the sample, as will be later described.

In each of the previous embodiments, the stage 13 was straightly moved over a large distance in the x-direction to convey the sample 15 between the observation position and the analysis position. It is also possible to replace this straight-type mechanism with a rotary type or other types of driving mechanism.

In the previous construction, if the target portion 15*a* is larger than the size of the laser irradiation range 21*a* (convergence diameter), the positioning accuracy is rather unimportant. However, to maximally extract the advantages of the present invention, it is preferable to employ a high-precision stage-driving mechanism 30. Specifically, the positioning accuracy of the stage 13 must be smaller than the convergence diameter of the laser light 21*a* so as to ensure the analysis of the target portion 15*a* even if the area of that portion is as small as zero. For example, if the convergence diameter of the laser light is 5 μm, the positioning accuracy of the stage 13 needs to be within the range of ±2.5 μm. Therefore, a stage-driving mechanism 30 that satisfies this condition is recommended.

In recent years, high-precision stages that have achieved a sub-micron level positioning accuracy with a movable range of several hundreds of millimeters by feedback control using Magnescale (TM), laser scale or other position-detecting techniques are commonly available. Use of such new devices will easily satisfy the previously stated condition. Otherwise, even without the feedback control, it is certainly possible to achieve the aforementioned level of positioning accuracy by normal open-loop control.

Since the previously described mass spectrometer has a high spatial resolution, it can be used for mass spectrometric imaging of a sample, in which a two-dimensional area of the sample is selected as the target portion instead of a point and a mapping analysis is carried out within that area to obtain useful information, such as the two-dimensional density distribution of a molecule having a given mass. There are many possible methods for selecting a two-dimensional area on the sample 15. A convenient, user-friendly method is to display an image captured with the CCD camera 34 on the screen of the display unit 34 and let the operator select a desired area on the image with a mouse or similar pointing device.

The method for moving the stage 13 to the analysis position after the selection of the two-dimensional area can be the same as in the previous embodiments. For example, it includes the following steps: the distance L and other values between a predetermined reference point (e.g. central point) within the scope and the laser irradiation range, and other values is precisely measured beforehand; the relative position (distance or coordinates) of the selected area to the reference point is determined; and a scanning analysis is carried out by repeatedly delivering the laser light while calculating the distance and other values between the selected area and the laser irradiation range and actually moving the stage according to those values. The scanning step width may preferably be selected by the operator according to necessity.

In analysis of the living cells, reducing the convergence diameter of the laser light generally decreases the number of molecules generated within the irradiation range. This will decrease the signal intensity and deteriorate the signal-to-noise (S/N) ratio. Therefore, the smallest possible convergence diameter is always the best choice; rather, it is preferable to make the convergence diameter variable according to the object to be analyzed. For example, suppose that the purpose of the analysis is to obtain information about the entire cell nucleus of 5 μm across and no spatial resolution finer than that is required. Then, even if the apparatus can generate a laser light having a convergence diameter of 1 μm, the convergence diameter should be intentionally set at 5 μm. This setting creates a larger laser irradiation range and increase the signal intensity. This improves the S/N ratio and enhances the analysis sensitivity.

Using a laser light having a variable convergence diameter is also advantageous in the case of mapping analysis. For example, if the scanning step width is 5 μm, the spatial resolution of the mapping is also 5 μm, and it is meaningless to use a laser light whose convergence diameter is smaller than that. In such a case, the convergence diameter of the laser light should be equal to the scanning step width, whereby the S/N ratio is improved and the analysis sensitivity is enhanced while maintaining the spatial resolution.

The variability of the convergence of the laser light can be achieved by any method. However, to maximally extract the advantages of the present invention, it is important to minimize the power loss of the laser light. For example, it is possible to automatically or manually move the laser-condensing optical system along its optical axis to change the condensing point of the laser light. If the laser-condensing optical system 22 is a combination of multiple lenses, the distance between the lenses may be changed. It is also allowable to replace the laser-condensing optical system 22 with another one having a different design.

It should be noted that the previous embodiments are mere examples of the present invention; any changes, modifications or extensions of the present invention of those embodiments within the spirit of the present invention will naturally be covered by the claims of the present application.

The invention claimed is:

1. A mass spectrometer for ionizing a component contained in a sample by irradiating the sample with laser light, for separating ions according to their mass-to-charge ratio, and for detecting the separated ions, comprising:

a) a sample observation system, including an observation optical system, for allowing an operator to observe a predetermined range of the sample with the naked eye or on a captured image and select a target portion to be analyzed;

b) a laser-delivering system, including a laser-condensing optical system, for condensing and delivering an ionizing laser light onto a predetermined point outside the aforementioned predetermined range observable through the sample observation system; and c) a sample conveyer for holding the sample and moving it so that the target portion of the sample selected by the operator through the sample observation system comes to the predetermined point onto which the laser light is delivered from the laser-delivering system; the sample conveyer including a stage on which the sample is to be placed;

a stage driver for moving the stage within a predetermined range; and a controller for calculating a control input for moving the target portion to the predetermined point onto which the laser light is delivered, when a position on the sample is selected as the target portion during the observation through the sample observation system, and for operating the stage driver according to the control input thereby calculated.

2. The mass spectrometer according to claim 1, wherein the sample conveyer is constructed so that it can move the sample with a positioning accuracy finer than an irradiation size on the sample of the laser light delivered from the laser-delivering system.

3. The mass spectrometer according to claim 1, wherein the sample observation system is constructed so that the aforementioned predetermined range is observed substantially vertical from above.

4. The mass spectrometer according to claim 1, wherein the laser-delivering system is constructed so that the convergence diameter of the laser light delivered onto the aforementioned predetermined point can be varied.

5. The mass spectrometer according to claim 1, wherein the mass spectrometer has an operational mode for carrying out an analysis by delivering the laser light onto the sample while moving the sample with the sample conveyer, so as to obtain two-dimensional distribution information about a presence and/or strength of a signal corresponding to molecules of a given mass within a given area on the sample selected by the operator using the sample observation system.

6. The mass spectrometer according to claim 1, comprising an ion source using a laser desorption ionization (LDI) technique.

7. The mass spectrometer according to claim 1, comprising an ion source using matrix-assisted laser desorption ionization (MALDI) technique.

8. The mass spectrometer according to claim 2, wherein the sample observation system is constructed so that the aforementioned predetermined range is observed substantially vertical from above.

9. The mass spectrometer according to claim 2, wherein the laser-delivering system is constructed so that the convergence diameter of the laser light delivered onto the aforementioned predetermined point can be varied.

10. The mass spectrometer according to claim 3, wherein the laser-delivering system is constructed so that the convergence diameter of the laser light delivered onto the aforementioned predetermined point can be varied.

11. The mass spectrometer according to claim 2, wherein the mass spectrometer has an operational mode for carrying out an analysis by delivering the laser light onto the sample while moving the sample with the sample conveyer, so as to obtain two-dimensional distribution information about a presence and/or strength of a signal corresponding to molecules of a given mass within a given area on the sample selected by the operator using the sample observation system.

12. The mass spectrometer according to claim 3, wherein the mass spectrometer has an operational mode for carrying out an analysis by delivering the laser light onto the sample while moving the sample with the sample conveyer, so as to obtain two-dimensional distribution information about a presence and/or strength of a signal corresponding to molecules of a given mass within a given area on the sample selected by the operator using the sample observation system.

13. The mass spectrometer according to claim 4, wherein the mass spectrometer has an operational mode for carrying out an analysis by delivering the laser light onto the sample while moving the sample with the sample conveyer, so as to obtain two-dimensional distribution information about a presence and/or strength of a signal corresponding to molecules of a given mass within a given area on the sample selected by the operator using the sample observation system.

* * * * *